US010745888B2

(12) United States Patent
Kukuk

(10) Patent No.: US 10,745,888 B2
(45) Date of Patent: Aug. 18, 2020

(54) HYDRAULIC FLOW MANIFOLD FOR ATTACHMENTS

(71) Applicant: The Charles Machine Works, Inc., Perry, OK (US)

(72) Inventor: Brant Douglas Kukuk, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 497 days.

(21) Appl. No.: 15/782,395

(22) Filed: Oct. 12, 2017

(65) Prior Publication Data

US 2018/0127950 A1 May 10, 2018

Related U.S. Application Data

(60) Provisional application No. 62/408,495, filed on Oct. 14, 2016.

(51) Int. Cl.

| | |
|---|---|
| ***E02F 9/22*** | (2006.01) |
| ***E02F 9/20*** | (2006.01) |
| ***E02F 7/04*** | (2006.01) |
| *E02F 5/14* | (2006.01) |

(52) U.S. Cl.

CPC ..... *E02F 9/2271* (2013.01); *E02F 7/04* (2013.01); *E02F 9/2012* (2013.01); *E02F 9/2267* (2013.01); *E02F 5/145* (2013.01); *E02F 9/2203* (2013.01)

(58) Field of Classification Search

CPC ..... E02F 9/2267; E02F 9/0875

See application file for complete search history.

(56) References Cited

U.S. PATENT DOCUMENTS

| | | | | |
|---|---|---|---|---|
| 3,589,242 A * | 6/1971 | Peterson | E02F 3/6481 91/523 |
| 3,705,631 A | 12/1972 | Seaberg | |
| 3,811,336 A | 5/1974 | Pulskamp | |
| 4,170,168 A * | 10/1979 | Jenkins | E02F 9/2271 180/324 |
| 5,299,857 A | 4/1994 | Zanetis | |
| 5,463,931 A * | 11/1995 | Karlsson | B66C 13/18 91/428 |

(Continued)

FOREIGN PATENT DOCUMENTS

WO WO 2016-76288 * 5/2016

*Primary Examiner* — Gerald McClain

(74) *Attorney, Agent, or Firm* — Tomlinson McKinstry, P.C.

(57) ABSTRACT

A work vehicle is formed from a plurality of ground-contacting motive elements, a chassis, an operator station, a switch, and a hydraulic manifold. The operator station has a joystick having a manually-actuable control element used to actuate the switch. The hydraulic manifold has a pair of primary hydraulic ports, first and second pairs of secondary hydraulic ports, and a control valve. The control valve is actuated by the switch and is adapted to allow pressurized hydraulic fluid to flow through a selected one of the first or second pair of secondary hydraulic ports. Each pair of secondary hydraulic ports fluidly communicates with a hydraulic actuator carried by a work attachment. By actuating the control element on the joystick, the operator can conveniently switch the hydraulic control of the joystick between different hydraulic operations on the attachment without leaving the operator's station.

12 Claims, 7 Drawing Sheets

(56) References Cited

U.S. PATENT DOCUMENTS

| | | | | |
|---|---|---|---|---|
| 5,473,970 | A * | 12/1995 | Hayashi | E02F 9/2221 91/523 |
| 7,036,248 | B2 | 5/2006 | Meyeres et al. | |
| 9,629,299 | B2 * | 4/2017 | Swanson | E02F 9/2267 |
| 2003/0010196 | A1 * | 1/2003 | Smith | E02F 9/2267 91/536 |
| 2015/0107712 | A1 * | 4/2015 | Kobayashi | F15B 13/0842 137/884 |
| 2017/0152646 | A1 | 6/2017 | Sewell | |
| 2017/0241105 | A1 * | 8/2017 | Yuzawa | F16D 31/08 |

* cited by examiner

HYDRAULIC FLOW MANIFOLD FOR ATTACHMENTS

CROSS REFERENCE TO RELATED APPLICATION

This application claims the benefit of U.S. Provisional Patent Application Ser. No. 62/408,495 filed Oct. 14, 2016, the entire contents of which are incorporated herein by reference.

FIELD

The present invention relates to hydraulic fluid control systems for work vehicles having work attachments.

SUMMARY

A work vehicle is formed from a plurality of ground-contacting motive elements, a chassis, an operator station, a switch, and a hydraulic manifold. The chassis is supported on the motive elements. The operator station is supported on the chassis and comprises a joystick. The joystick is pivotable along a single axis and has a manually-actuable control element. The switch is actuated by the control element. Supported on the chassis, the hydraulic manifold has a pair of primary ports, first and second pairs of secondary ports, and a control valve that is actuated by the switch. The control valve has a first position and a second position. The first position opens a first fluid path through the first pair of secondary ports. The second position opens a second fluid path through the second pair of secondary ports.

A work vehicle is formed from a plurality of ground-contacting motive elements, a chassis, a hydraulic power source, a first section of a power circuit, and a manifold. The chassis is supported on the motive elements. The hydraulic power source is supported on the chassis. The first section of a power circuit fluidly communicates with the power source. Supported on the chassis, the manifold has first, second, and third fluid paths, a control valve, and a plurality of excess flow lines. The first fluid path fluidly communicates with the first section. The second fluid path is adapted to fluidly communicate with a second section of a power circuit. The third fluid path is adapted to fluidly communicate with a third section of a power circuit. The control valve is adapted to join the first fluid path in fluid communication with a selected one of the second and third fluid paths. Each excess flow line has an upstream end, a downstream end, and a check valve interposed therebetween. The upstream end joins one and only one of the second and third fluid paths.

DETAILED DESCRIPTION

In hydraulic fluid systems, pressurized hydraulic fluid is used to power a hydraulic actuator, such as a hydraulic cylinder or motor. Work vehicles often use such systems to control work attachments. Such a vehicle may include multiple hydraulic actuators for controlling multiple operations of one or more attachments.

One or more operator controls, such as a joystick, are used to control the hydraulic fluid systems on such a work vehicle. By moving such a joystick in a particular direction, such as backwards and forwards, an operator controls a particular hydraulic actuator. That actuator in turn causes a particular work attachment to perform a particular function.

Traditionally, a single direction of joystick motion has been uniquely associated with a single hydraulic actuator, and thus a single work attachment function. In the presently disclosed invention, the same directional motion can be used for selective control of more than one hydraulic actuator, and thus more than one work attachment function.

Figure 1:
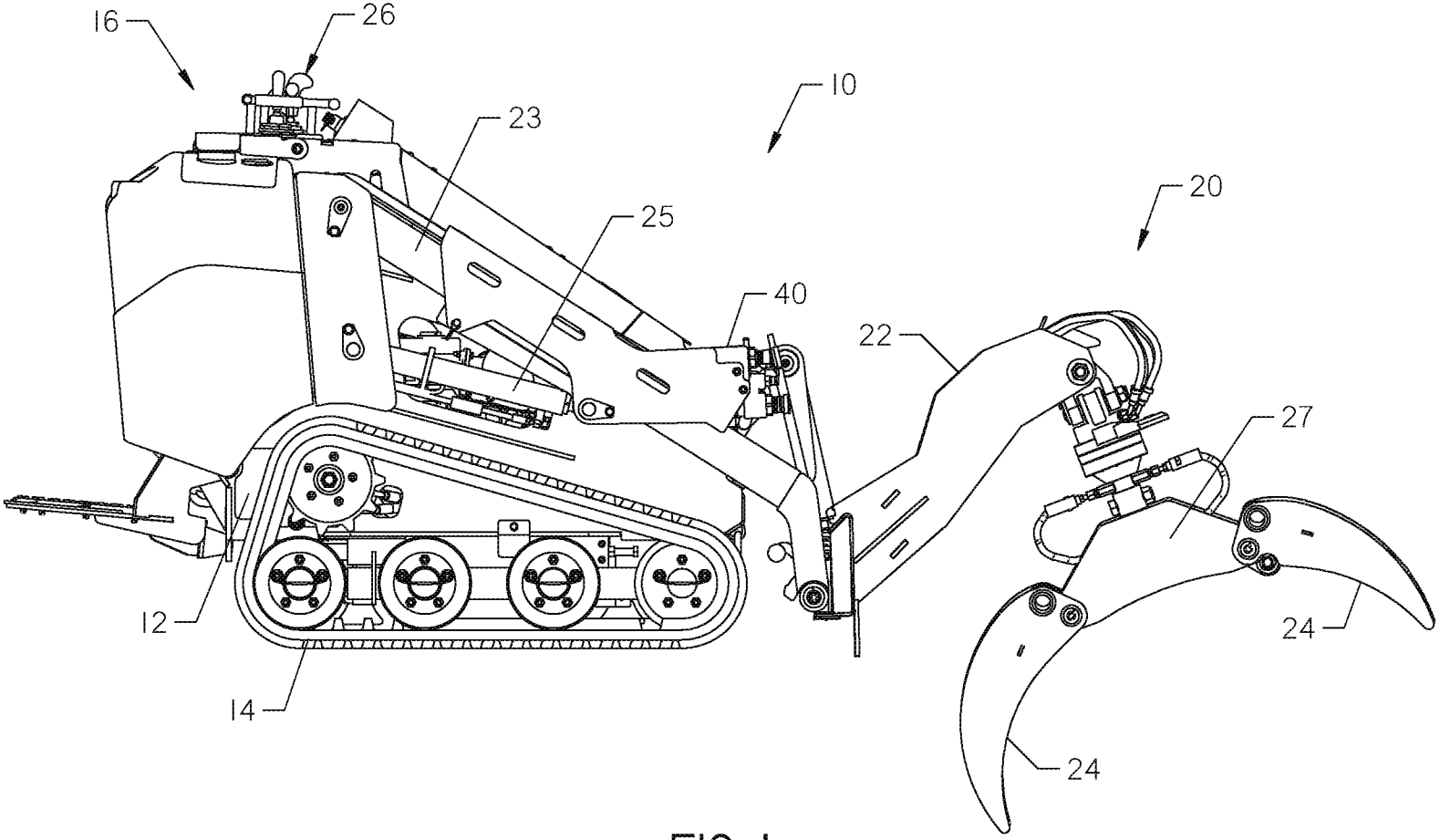
FIG. 1 is a side elevation view of a work vehicle having an operator's station, a hydraulic manifold, and a grapple.

Shown in FIG. 1 is a work vehicle 10 comprising a chassis 12, an engine that is supported by the chassis 12, a plurality of ground-contacting motive elements 14, an operator's station 16, and a hydraulic pressure system. The chassis 12 may support a work attachment, such as an excavator, a trencher, a bucket, a plow, a grapple, or any other suitable hydraulic implement. In embodiments, the work vehicle may support a plurality of work attachments configured to perform a plurality of hydraulic operations. The attachments may be situated at the front, the rear, or on the sides of the work vehicle 10. The work vehicle 10 of FIG. 1 features a grapple 20 situated at the front of the work vehicle 10. The grapple 20 has an arm 22, a center member 27, and a pair of pivotable jaws 24 supported on the center member 27. The work vehicle 10 has a lift arm 23 and lift cylinder 25 for raising and lowering the grapple 20.

The engine provides power to the hydraulic pressure system and the motive elements 14. The motive elements 14 support the chassis 12 as the work vehicle 10 is propelled over the ground. As shown in FIG. 1, the motive elements 14 are continuous track systems. In other embodiments the motive elements 14 may be wheels.

Figure 7:
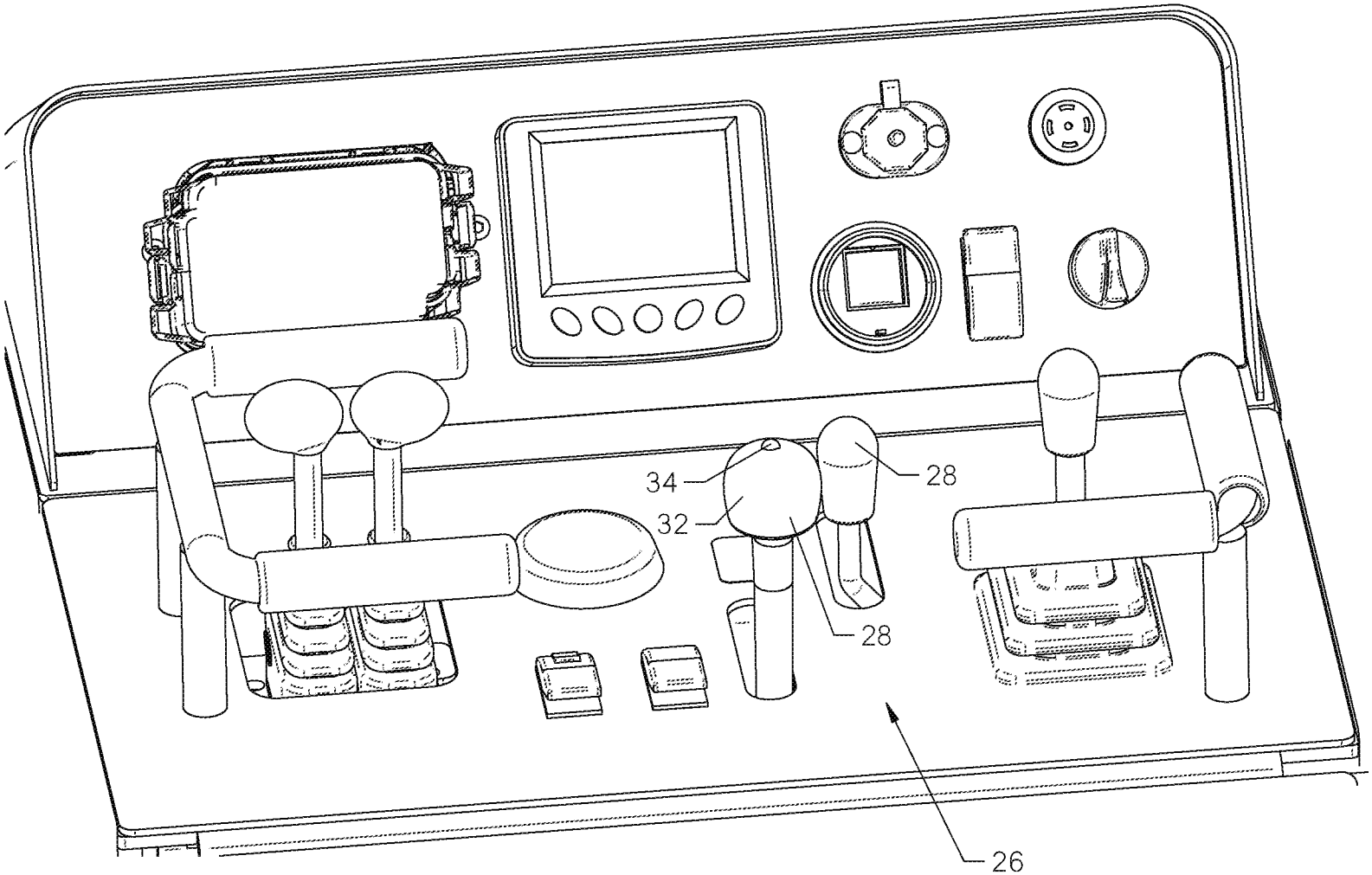
FIG. 7 is a perspective view of a plurality of joysticks located at the operator's station of FIG. 1. One of the joysticks is an attachment control joystick.

Turning to FIG. 7, the operator's station 16 comprises a plurality of joysticks 26. Each joystick 26 has a handle 28 and a pivot point. The joysticks 26 may be pivotable along a single axis or along a plurality of axes. At least one of the joysticks 26 is an attachment control joystick 32. Preferably, the attachment control joystick 32 is pivotable along a single axis. The attachment control joystick 32 has a manually-actuable control element 34 situated on the handle 28. The control element 34 may be a depressible button, a toggle switch, a selector switch or any suitable user input device. Preferably, the control element 34 may be actuated by the operator's thumb.

Figure 2:
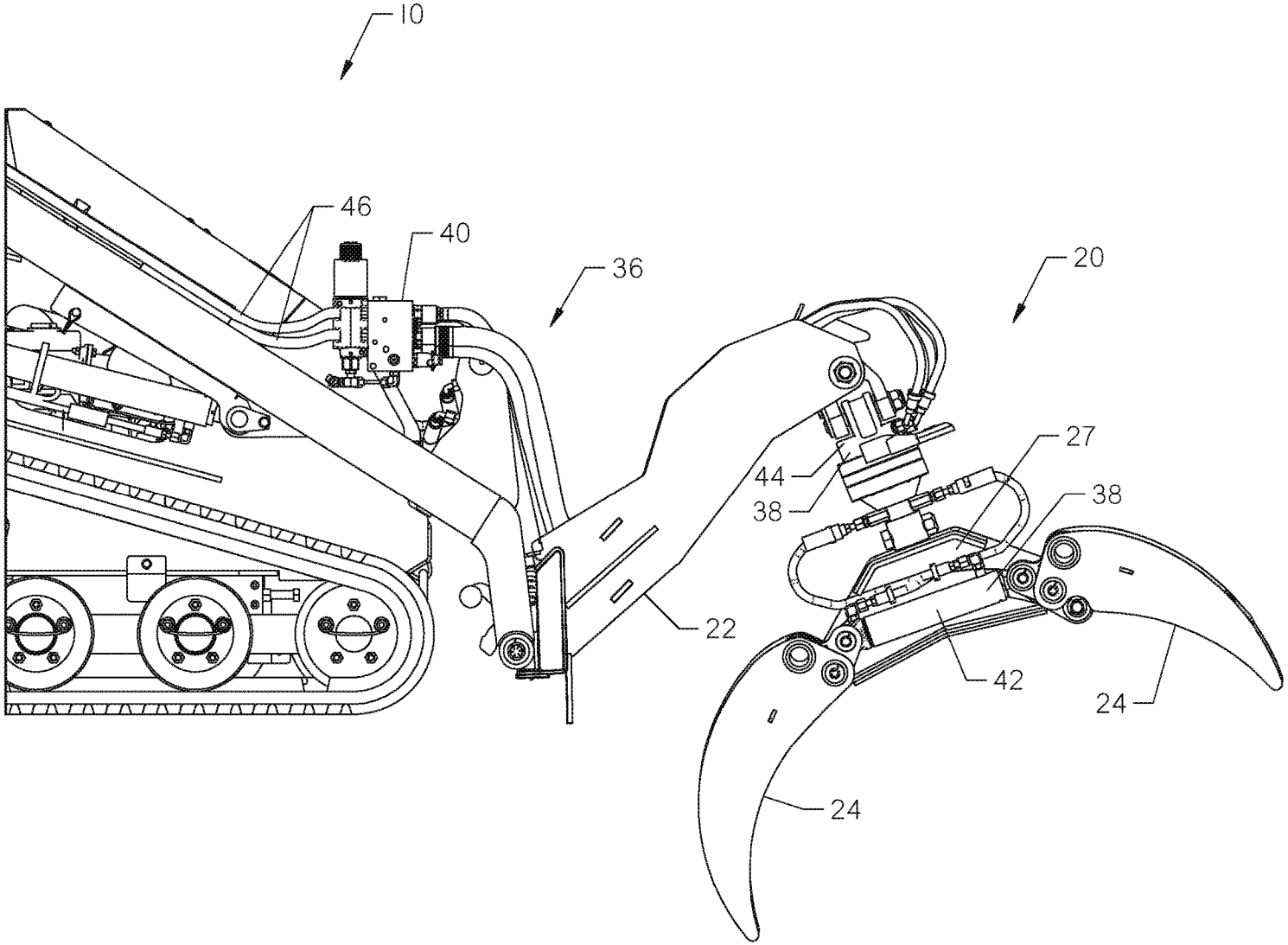
FIG. 2 is an enlarged side elevation view of a portion of the work vehicle of FIG. 1 showing a plurality of hydraulic hoses connected to the hydraulic manifold. A portion of a center member of the grapple has been removed to show a hydraulic cylinder.

With reference to FIGS. 1 and 2, the hydraulic pressure system includes a reservoir, a pump, a plurality of hydraulic hoses 36, a plurality of hydraulic actuators 38, and a hydraulic manifold 40. The components of the hydraulic pressure system form a fluid circuit through which hydraulic fluid flows. Powered by the engine, the pump creates a pressurized circuit of hydraulic fluid that may be used to operate the hydraulic actuators 38. Each hydraulic actuator 38 may be a hydraulic cylinder, a hydraulic motor, or any suitable hydraulically-powered element. The hydraulic actuators 38 convert the energy of the pressurized liquid into mechanical force or torque.

Figure 6:
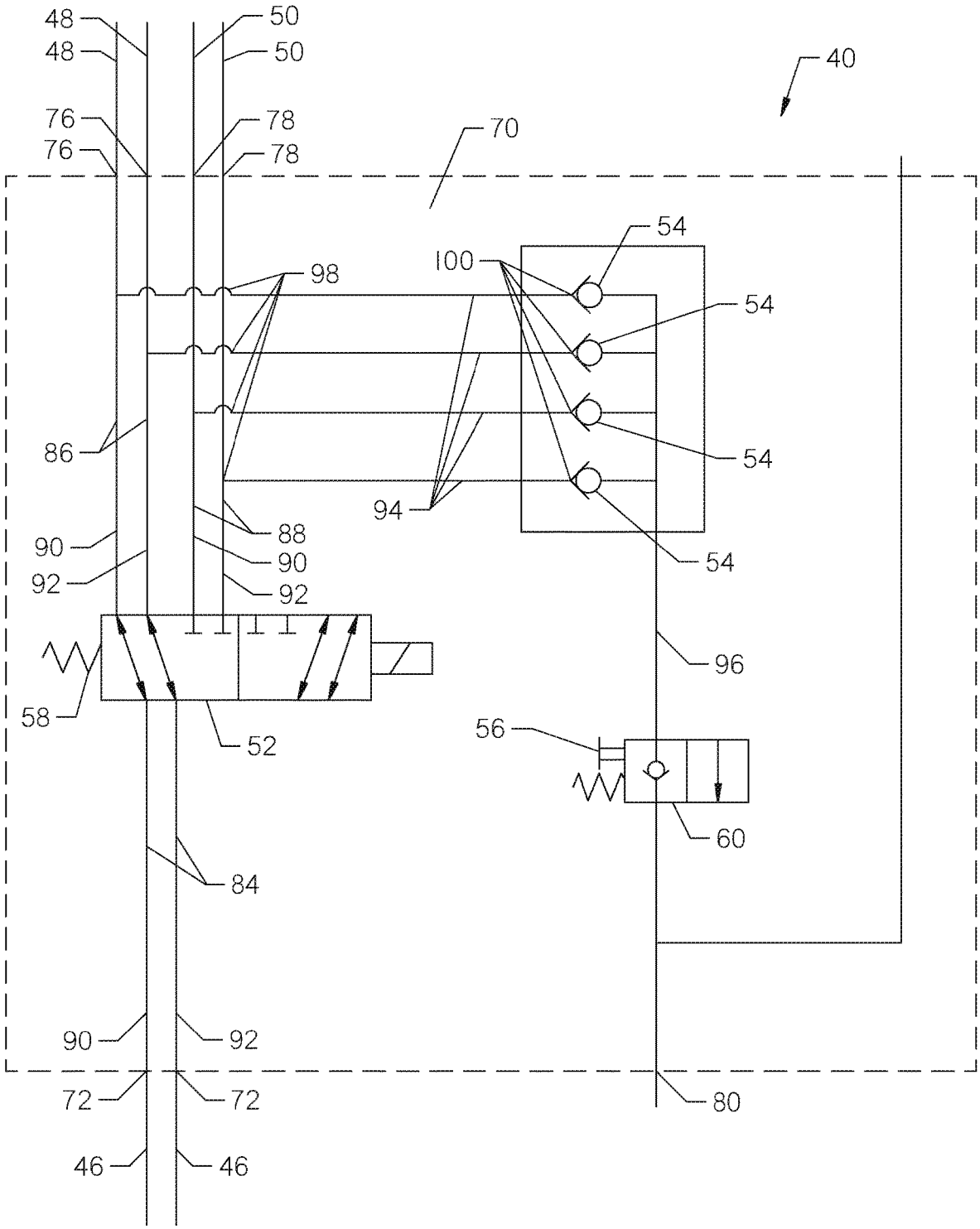
FIG. 6 is a plan view of a schematic of the hydraulic manifold of FIG. 1.

As shown in FIG. 2, one of the hydraulic actuators 38 is a cylinder 42 configured to open and close the jaws 24 of the grapple 20. Another of the hydraulic actuators 38 is a hydraulic motor 44 configured to rotate the jaws 24. With reference to FIG. 6, the plurality of hydraulic hoses 36 include a pair of primary hydraulic hoses 46 and first and second pairs of secondary hydraulic hoses 48, 50.

With reference to FIGS. 3-6, the hydraulic manifold 40 comprises a control valve 52, a plurality of check valves 54, a pressure discharge valve 60, and a pressure discharge control element 56. The control valve 52 has an electrical switch 58 that adjusts the control valve 52 between a first position and a second position. The control valve 52 may be any suitable valve for directing fluid flow from one fluid path to another, including a cartridge valve, an electric proportional valve, a solenoid-controlled valve, or a spool valve.

Figure 3:
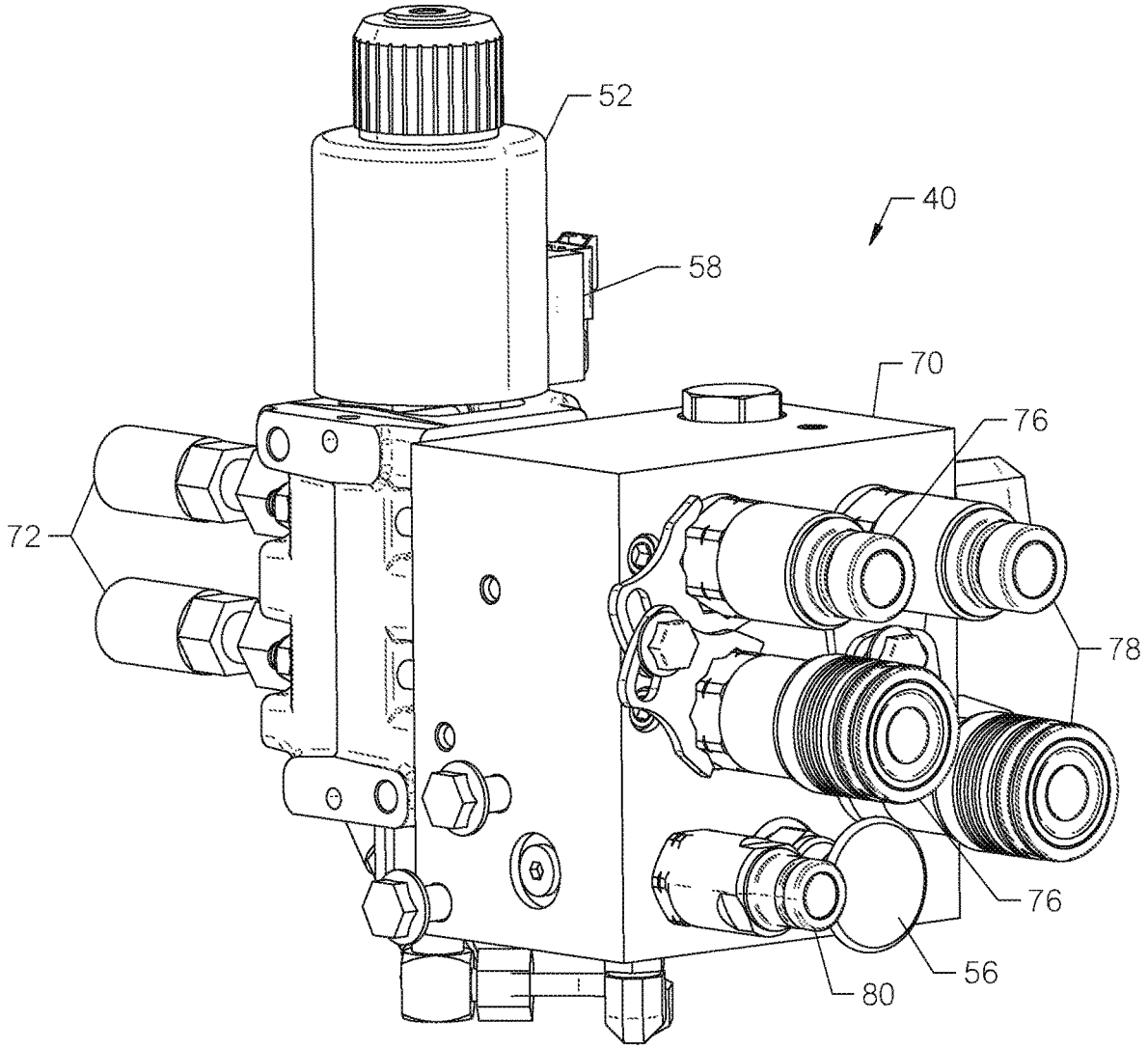
FIG. 3 is a front perspective view of the hydraulic manifold of FIG. 1.
Figure 4:
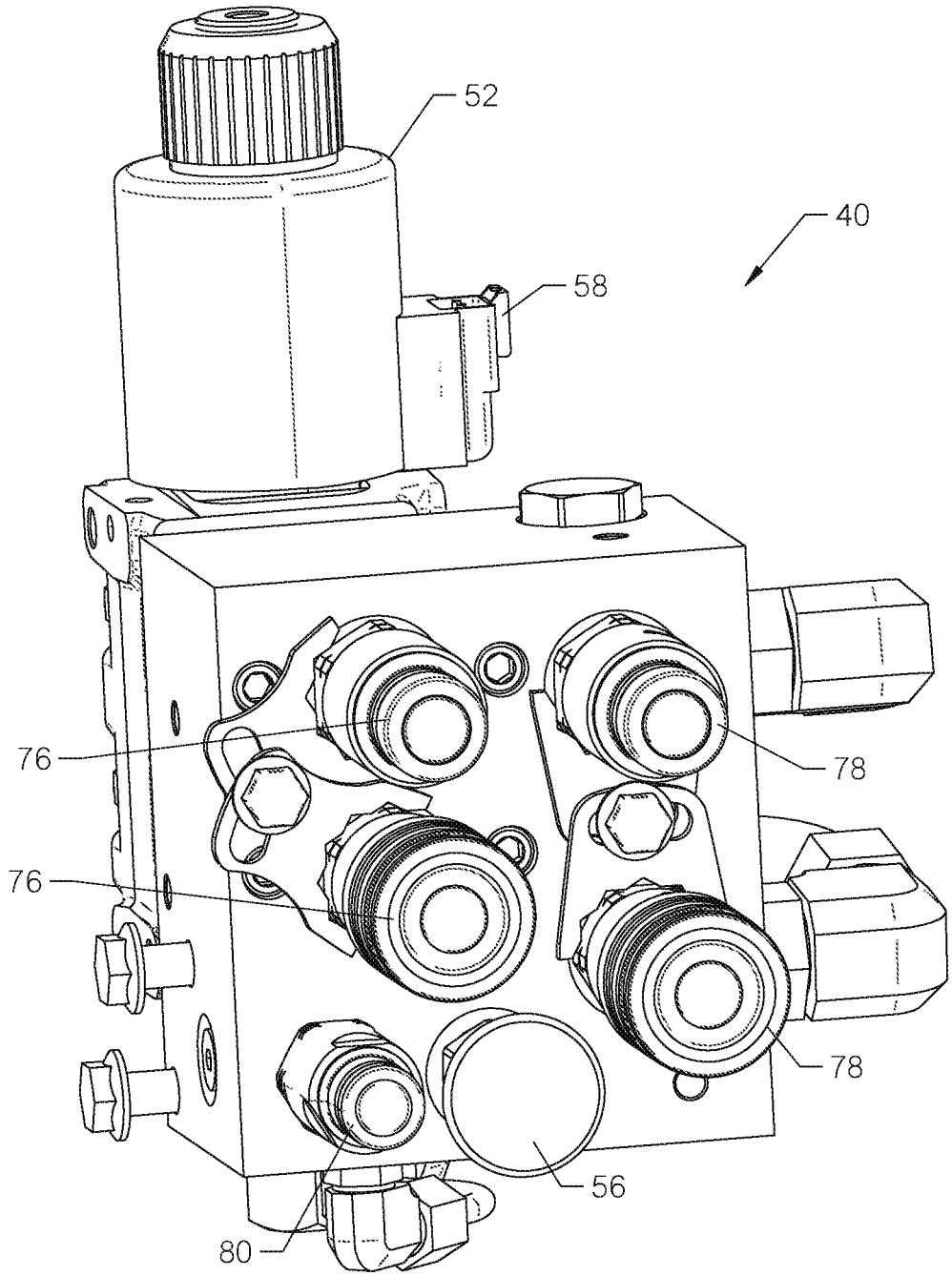
FIG. 4 is another front perspective view of the hydraulic manifold of FIG. 1.
Figure 5:
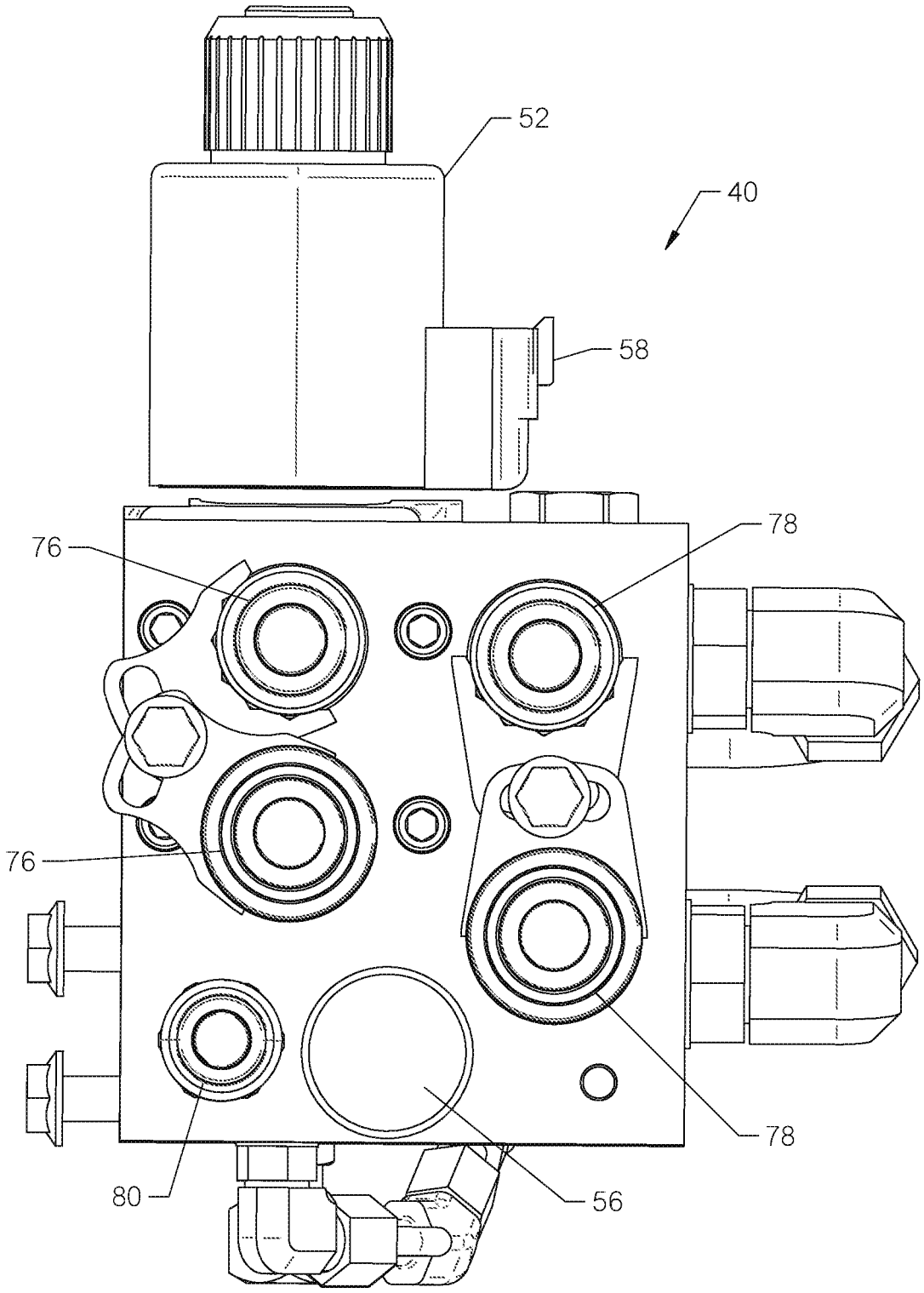
FIG. 5 is a front elevation view of the hydraulic manifold of FIG. 1.

Referring to FIG. 6, each check valve 54 and the pressure discharge valve 60 may be any suitable valve for allowing flow in only a single direction. With reference to FIGS. 3-5, the pressure discharge control element 56 features a pull handle. In other embodiments, the pressure discharge control element 56 may have a pivotable handle.

The hydraulic manifold 40 further comprises a body 70 formed from a strong and durable material, such as steel. The body 70 has a pair of primary ports 72 and a plurality of secondary ports. Preferably, the plurality of secondary ports comprises a first pair of secondary ports 76, a second pair of secondary ports 78, and a pressure discharge port 80.

Formed in the body 70 of the manifold 40, a plurality of passages extend between the primary ports 72 and the first and second pairs of secondary ports 76, 78. The passages comprise first, second, and third fluid paths 84, 86, 88. Each fluid path 84, 86, 88 has a first leg 90 and a second leg 92. Fluid flows through each first leg 90 in one direction and through each second leg 92 in the opposite direction. The primary ports 72 communicate fluidly by way of the first fluid path 84. The first pair of secondary ports 76 communicate fluidly by way of the second fluid path 86. The second pair of secondary ports 78 communicate fluidly by way of the third fluid path 88.

The control valve 52 joins the first fluid path 84 to a selected one of the second and third fluid paths 86, 88. When the control valve 52 is in the first position, the first fluid path 84 is in fluid communication with the second fluid path 86. When the control valve 52 is in the second position, the first fluid path 84 is in fluid communication with the third fluid path 88.

The plurality of passages formed in the body 70 further comprise a plurality of excess flow lines 94 and a pressure discharge line 96. Each excess flow line 94 has an upstream end 98 and a downstream end 100. One of the plurality of check valves 54 is interposed in each excess flow line 94 between its upstream and downstream ends 98, 100. Each upstream end 98 joins one and only one of the second and third fluid paths 86, 88. Each downstream end 100 joins the pressure discharge line 96. The pressure discharge line 96 extends from the excess flow lines 94 to the pressure discharge port 80. The pressure discharge valve 60 is disposed in the pressure discharge line 96.

In the assembled work vehicle 10, the pair of primary hydraulic hoses 46 extend from the reservoir to the pair of primary ports 72 of the manifold 40. The first pair of secondary hydraulic hoses 48 extend from the first pair of secondary ports 76 of the manifold 40 to the cylinder 42 of the grapple 20. The second pair of secondary hydraulic hoses 50 extend from the second pair of secondary ports 78 of the manifold 40 to the motor 44 of the grapple 20.

The switch 58 controls which pair of secondary hydraulic hoses 48, 50 receives the pressurized hydraulic fluid that circulates through the fluid circuit. By actuating the switch 58, the control valve 52 is shifted between the first valve position and the second valve position. When the control valve 52 is in the first position, the pressurized hydraulic fluid flows between the first fluid path 84 and the second fluid path 86. In the first valve position, hydraulic power is supplied to the cylinder 42. On the other hand, when the control valve 52 is in the second position, the pressurized hydraulic fluid flows between the first fluid path 84 and the third fluid path 88. In the second valve position, hydraulic power is supplied to the motor 44.

The operator may select the valve position by actuating the manual control element 34 situated on the attachment control joystick 32. The switch 58 of the manifold 40 is actuated by the manual control element 34. When the control valve 52 is in the first position, the operator opens the jaws 24 by pivoting the joystick 32 in a first direction and closes the jaws 24 by pivoting the joystick 32 in an opposite second direction. To rotate the grapple 20, the operator actuates the control element 34 on the joystick 32 to switch the control valve 52 to the second position. When the control valve 52 is in the second position, the operator rotates the grapple 20 in a first direction by pivoting the joystick 32 in the first direction. The operator rotates the grapple 20 in a second direction by pivoting the joystick 32 in the second direction. Thus, the same joystick 32, pivoting along the same axis, is used to selectively control two different hydraulic operations on the same attachment. By making the selection using the control element 34 on the joystick 32, the operator can conveniently switch the hydraulic control of the joystick 32 between different hydraulic operations without leaving the operator's station 16.

FIGS. 1 and 2 illustrate the use of the presently disclosed system to control a cylinder and a motor carried by a single grapple attachment. However, the system may be used to control any suitable pair of hydraulic actuators carried by a single work attachment or by multiple work attachments. In other embodiments, the system may be configured to include a plurality of valves for selectively controlling three or more hydraulic operations.

During the course of operation, the pressure in the hydraulic manifold 40 can increase. To release some of the pressure, the operator pulls the pressure discharge control element 56 to open the pressure discharge valve 60. Opening the pressure discharge valve 60 causes the check valves 54 to open. The pressurized hydraulic fluid then rushes through the pressure discharge line 96 to relieve the pressure in the hydraulic manifold 40. The check valves 54 release pressure in the order of highest to lowest pressure of the excess flow lines 94 in which the check valves 54 are interposed. Releasing pressure from the manifold 40 is particularly advantageous when the operator needs to change attachments. By allowing hydraulic fluid to flow into the pressure discharge line 96, pressure at the secondary ports 76, 78 decreases, making it easier to connect and disconnect attachments.

Changes may be made in the construction, operation and arrangement of the various parts, elements, steps and procedures described herein without departing from the spirit and scope of the invention as described in the following claims.

The invention claimed is:

1. A work vehicle, comprising:

a plurality of ground-contacting motive elements;

a chassis supported on the motive elements;

an operator station supported on the chassis, and comprising:

a joystick pivotable along a single axis and having a manually-actuable control element;

a switch actuated by the control element; and a hydraulic manifold supported on the chassis, and having a pair of primary ports, first and second pairs of secondary ports, and a control valve actuated by the switch and having a first position that opens a first fluid path through the first pair of secondary ports and a second position that opens a second fluid path through the second pair of secondary ports.

2. The work vehicle of claim 1, further comprising:

a work attachment removably connected to the chassis and having a plurality of hydraulic actuators in fluid communication with the secondary ports.

3. The work vehicle of claim 2 in which at least one of the hydraulic actuators is a hydraulic cylinder.

4. The work vehicle of claim 2 in which at least one of the hydraulic actuators is a hydraulic motor.

5. The work vehicle of claim 2 in which the work attachment comprises a grappler having a pair of pivotable jaws in which one of the hydraulic actuators is a cylinder configured to open and close the jaws and another of the hydraulic actuators is a motor configured to rotate the pair of jaws.

6. The work vehicle of claim 1, further comprising:

a pivotable lift arm in which the hydraulic manifold is situated on the lift arm.

7. The work vehicle of claim 1, the hydraulic manifold further comprising:

a plurality of check valves in which each secondary port is in fluid communication with one of the check valves; and a discharge valve in fluid communication with the check valves.

8. The work vehicle of claim 7, further comprising:

a hand-operated control element configured to open the discharge valve.

9. The work vehicle of claim 7 in which fluid flows through the check valves from upstream to downstream and in which the check valves having a higher upstream pressure open before the check valves having a lower upstream pressure.

10. A work vehicle, comprising:

a plurality of ground-contacting motive elements;

a chassis supported on the motive elements;

a hydraulic power source supported on the chassis;

a first section of a power circuit fluidly communicating with the power source; and a manifold supported by the chassis, and comprising:

a first fluid path fluidly communicating with the first section;

a second fluid path adapted to fluidly communicate with a second section of a power circuit;

a third fluid path adapted to fluidly communicate with a third section of a power circuit;

a control valve adapted to join the first fluid path in fluid communication with a selected one of the second and third fluid paths; and a plurality of excess flow lines, each excess flow line having an upstream end joining one and only one of the second and third fluid paths, a downstream end, and a check valve interposed therebetween.

11. The vehicle of claim 10 in which each fluid path and each section is characterized by a pair of legs having opposite directions of fluid flow.

12. The vehicle of claim 11 in which each leg of each of the second and third fluid paths is joined by the upstream end of one of the plurality of excess flow lines.

* * * * *